United States Patent [19]

Symons

[11] Patent Number: 4,943,256

[45] Date of Patent: Jul. 24, 1990

[54] AMUSEMENT DEVICE PROPELLED BY AN ECCENTRIC APPARATUS

[75] Inventor: Robert W. Symons, Incline Village, Nev.

[73] Assignee: PN International Corp., Mt. Kisco, N.Y.

[21] Appl. No.: 142,817

[22] Filed: Jan. 11, 1988

[51] Int. Cl.[5] ..... A63H 11/12; A63H 17/25; A63H 30/04; A63H 17/00

[52] U.S. Cl. ..... 446/278; 446/287; 446/456; 446/437; 180/7.1; 272/27 N; 280/1

[58] Field of Search ..... 446/278, 279, 287, 288, 446/290, 368, 484, 485, 454, 456, 470, 486, 436, 437, 409; 272/8 R, 8 N, 27 N; 273/428; 180/7.1; 280/1

[56] References Cited

U.S. PATENT DOCUMENTS

| | | | |
|---|---|---|---|
| 1,808,766 | 6/1931 | De Filippis | 446/436 |
| 2,607,163 | 8/1952 | Lohr | 446/457 X |
| 3,395,483 | 8/1968 | Mullins | 446/278 |
| 4,143,484 | 3/1979 | Yonezawa | 446/278 |
| 4,363,187 | 12/1982 | Shinohara | 446/437 |
| 4,393,620 | 7/1983 | Murakami | 446/471 X |
| 4,579,541 | 4/1986 | Kulesza et al. | 446/304 |
| 4,597,744 | 7/1986 | Rehkemper et al. | 446/278 |
| 4,623,317 | 11/1986 | Nagano | 446/487 X |
| 4,626,223 | 12/1986 | Sweet | 446/470 X |
| 4,678,951 | 7/1987 | Ventura | 446/471 |

FOREIGN PATENT DOCUMENTS

| | | | |
|---|---|---|---|
| 698487 | 1/1931 | France | 446/436 |
| 2184662 | 7/1987 | United Kingdom | 446/279 |

*Primary Examiner*—Robert A. Hafer
*Assistant Examiner*—D. Neal Muir
*Attorney, Agent, or Firm*—Jones, Day, Reavis & Pogue

[57] ABSTRACT

An amusement device consisting of a base frame having a first and second end. A pair of ratchet wheel assemblies mounted to an supporting the second end of the base frame. A motor is mounted within the base frame. A cam is rotatably driven by the motor. A yoke assembly having a first and second end in which the second end of the yoke assembly is oscillatorially activated by the cam to cause the first end of the yoke assembly to oscillate relative to the first end of the base frame. A pair of ratchet wheel assemblies are mounted at the first end of the yoke assembly such that when the first end of the yoke assembly oscillates, the ratchet wheels rotate.

12 Claims, 8 Drawing Sheets

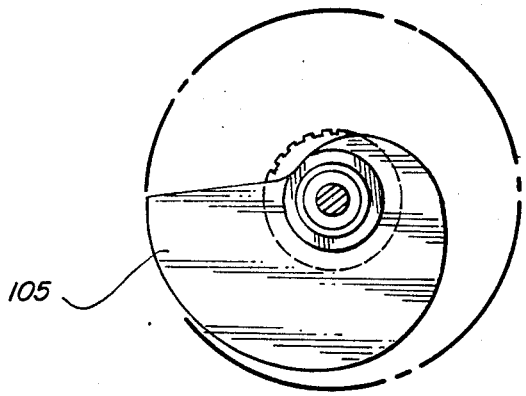
FIG. 6
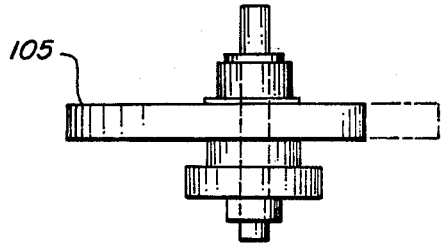
FIG. 7
FIG. 8
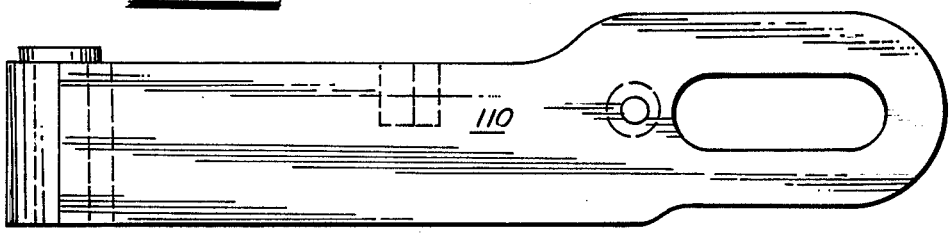
FIG. 9
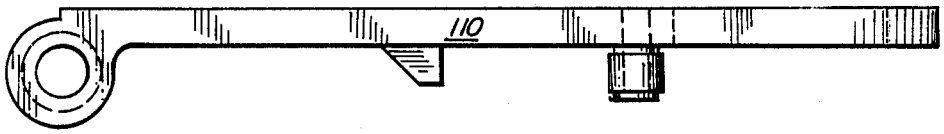
FIG. 10
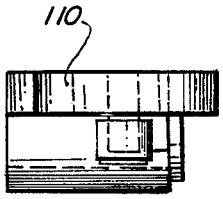

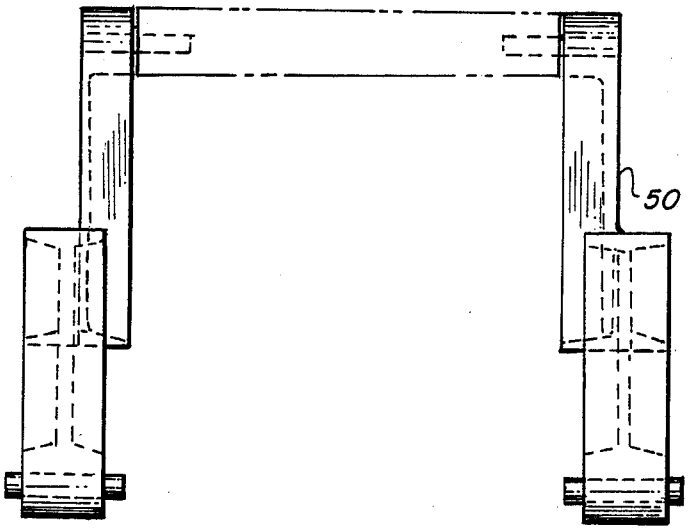
FIG. 14
FIG. 17
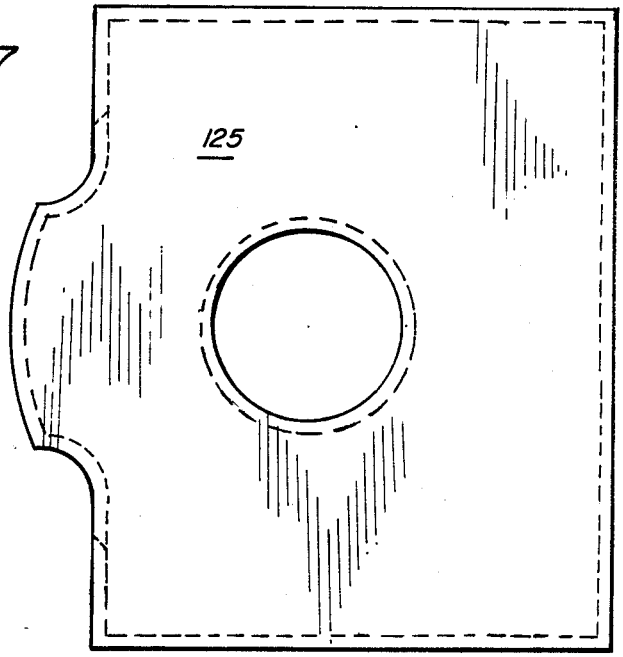
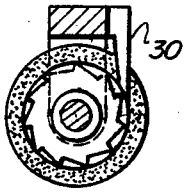
FIG. 15
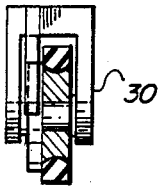
FIG. 16
FIG. 18
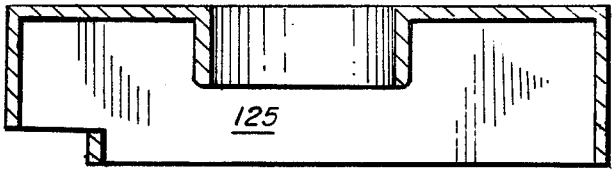

AMUSEMENT DEVICE PROPELLED BY AN ECCENTRIC APPARATUS

The present invention relates generally to an amusement device propelled by an eccentric apparatus. Specifically, a device which mimics a human "coughing" motion which is created by the interaction of a cam with a jointed yoke assembly in which the resulting oscillation causes ratchet type wheels to rotate and propel the overall device in sync with the "coughing" motion.

BACKGROUND OF THE INVENTION

The unique cam and jointed yoke assembly of the present invention provides a synchronous "up and down" type motion with intermittent horizontal travel for realism in an amusement device that appears to "cough" and crawl away. No known device operates in the disclosed and claimed manner which insures lifelike operation in which the resultant motions are operatively in sync with each other.

BRIEF SUMMARY OF THE INVENTION

A base supported on one end by two ratchet type wheel assemblies and supported on the other end by a movable jointed yoke assembly which is supported by another pair of ratchet type wheel assemblies. The jointed yoke assembly is resiliently biased toward the base. A flexible shell, configured to appear as a "rock" or other desired shape, is affixed only to the aft or wheeled end of the yoke assembly and to the forward end of the base. A prime mover or motor is mounted on the base and drives an eccentric motion producing apparatus such as a cam or rack and pinion type arrangement. The activated eccentric apparatus transfers longitudinal periodic motion to the moveable yoke assembly, causing the yoke to oscillate to and from the base and in turn causing the flexible shell to produce a "humping" motion so that the "rock" appears to "cough." As an additional product of this oscillatory motion, the movement of the jointed yoke causes the four ratchet type wheal assemblies to increment and intermittently partially rotate. The rotation of the wheels causes horizontal movement of the overall device. By the use of an eccentric mechanism, the amusement device synchronously coughs and crawls.

The amusement device can be activated by a smoke detection apparatus where upon the device starts to cough and crawl in response to the presence of smoke. The device may also roll over as part of the sequence of coughing and crawling.

Numerous other advantages and features of the invention will become readily apparent from the following detailed description of the preferred embodiment of the invention, from the claims and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein:

FIG. 6 is a top view of the cam/gear assembly of the present invention;

FIG. 7 is a side view of the cam/gear assembly of the present invention;

FIG. 8 is a top view of the cam follower assembly of the present invention;

FIG. 9 is a side view of the cam follower assembly of the present invention;

FIG. 10 is an end view of the cam follower assembly of the present invention;

FIG. 14 is a top view of the forward yoke of the present invention;

FIG. 15 is a side elevational view of the ratchet wheel assembly;

FIG. 16 is a front view of the ratchet wheel assembly;

FIG. 17 is a top view of the reverberation chamber of the present invention; and FIG. 18 is a side view of the reverberation chamber of the present invention.

DETAILED DESCRIPTION OF THE INVENTION

Figure 1:
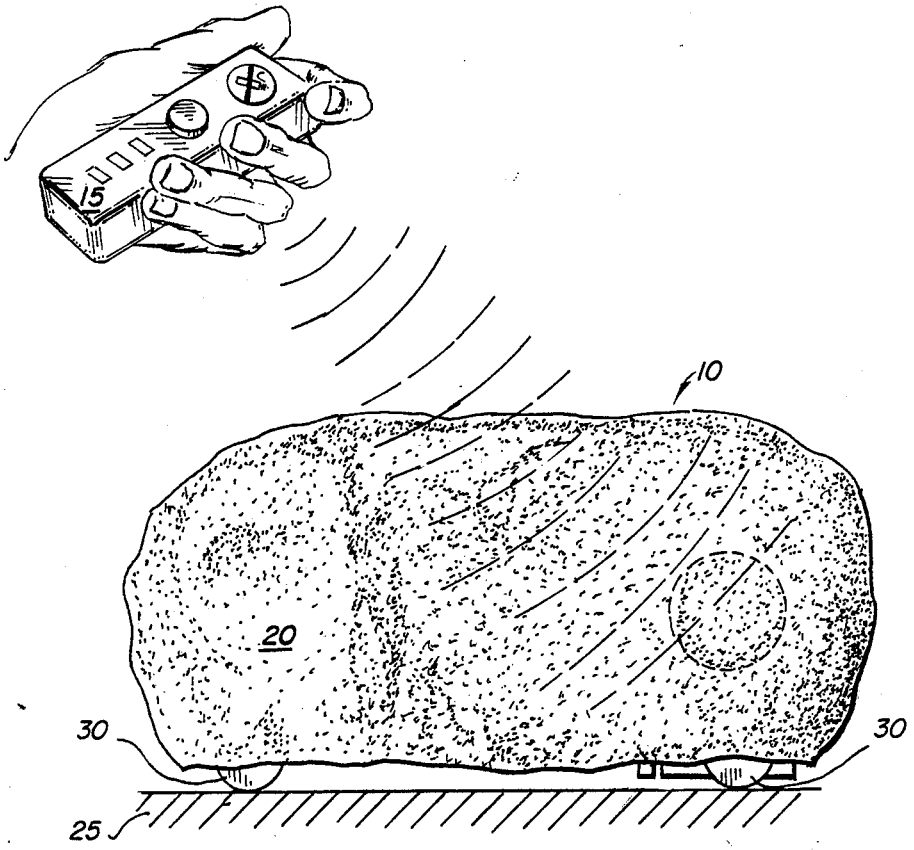
FIG. 1 is a side perspective view of the amusement device of the present invention.

While the invention is susceptible of embodiment in many different forms, there is shown in the drawings and will herein be described in detail a preferred embodiment of the invention. It should be understood, however, that the present disclosure is to be considered as an exemplification of the principles of the invention and is not intended to limit the spirit and scope of the invention and/or claims to the embodiment illustrated.

The invention produces two sychronous motions from an eccentric motion producing apparatus contained within a flexible shell. The eccentric motion may be produced by a cam and cam follower assembly or a rack and pinion type arrangement. The eccentric rotational energy is converted into longitudinal motion which is connected to the jointed yoke assembly. The jointed yoke assembly causes the flexible shell to momentarily form a "hump" resembling a "coughing" action along with a horizontal motion or "crawl" via four ratchet wheel assemblies.

Referring now to FIG. 1, the numeral 10 refers generally to the amusement device of the present invention. An associated activation and control device 15 is depicted in wireless communication to the amusement device 10. A flexible shell housing 20 is depicted to appear "rock-like." Associated horizontal surface 25 is shown supporting ratchet wheel assemblies 30. Ratchet wheel assemblies 30 are conventional and well known in the art.

Figure 2:
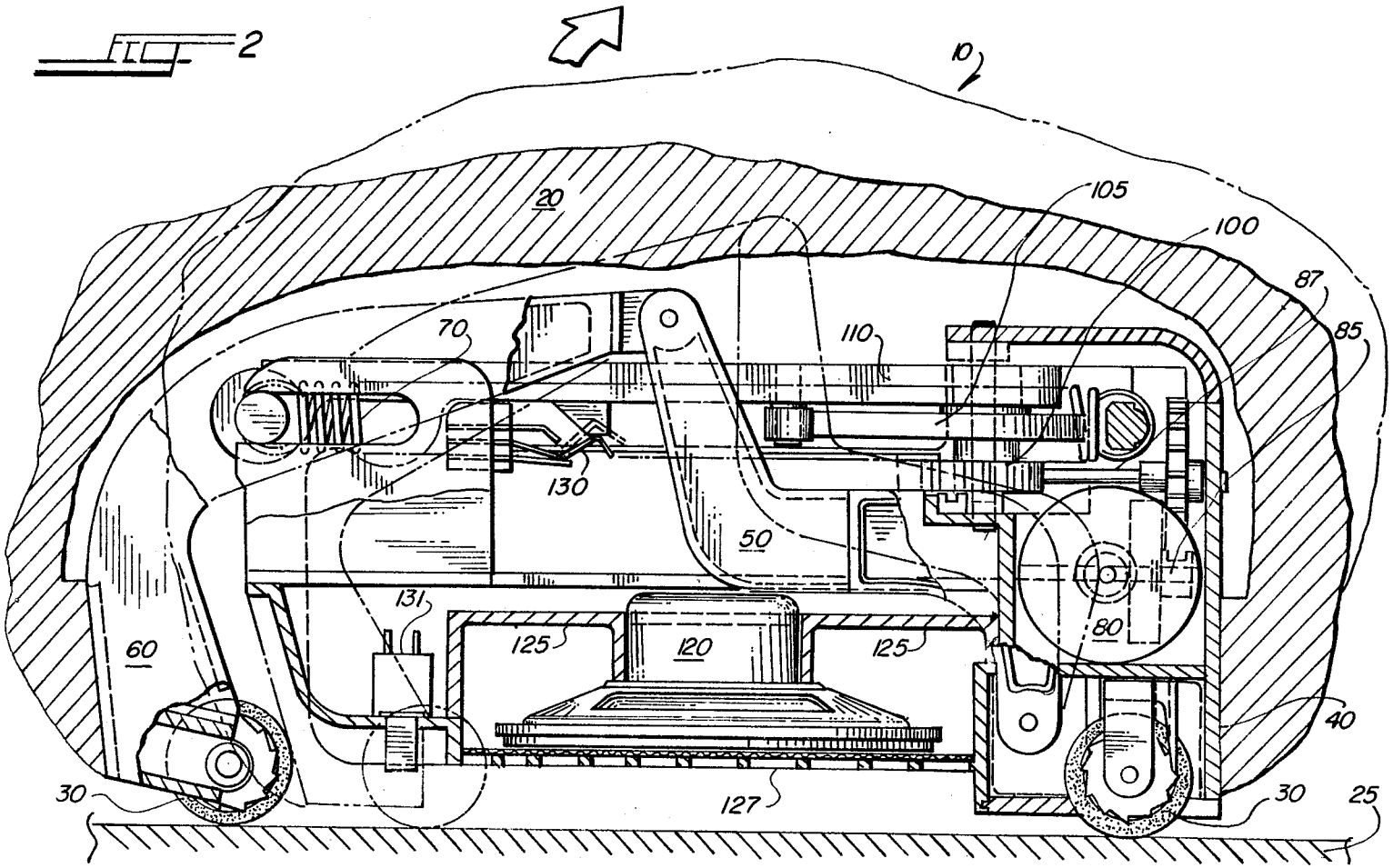
FIG. 2 is a side cut-away view of the present invention.

FIG. 2 is a side cut-away view of the overall device 10 in which shell housing 20 is shown in its static rest position and its "coughing" motion by the outline form. Base 40 is shown supported by ratchet wheel assembly 30 which in turn is supported by associated horizontal surface 25. Forward yoke 50 is shown in partial cut away and outline form with one end mounted to base 40 and the other end connected to aft yoke 60. Aft yoke 60 and forward yoke 50 are resiliently biased by a spring 70 (only partially shown) towards base 40. Aft yoke 60 is supported by two ratchet wheel assemblies 30 which rest upon surface 25. Flexible shell 20 is affixed only to the exterior edge of aft yoke 60 and the front end of base 40. Motor 80 rotationally drives gear train 85 to transmit rotational energy to spindle 87 and worm gear 90 which rotationally drives cam gear assembly 100 in which cam 105 is a part thereof. The cam follower assembly 110 produces longitudinal motion from cam 105 causing the jointed yoke assembly, forward yoke 50 and aft yoke 60, to move in an oscillatory motion relative to the base 40. In a single complete cycle, the jointed yoke assembly overcomes the bias caused by spring 70 and is positioned away from base 40 and then closer to and overlapping base 40 thereby causing flexible shell housing 20 to momentarily rise. Concurrently, the motion of yokes 50, 60 cause the ratchet wheel assemblies 30 to increment and rotate along the associated horizontal surface 25. Sound emitting device 120 is shown positioned within base 40 and within reverberation chamber 125 and is enclosed by speaker grill housing 127. The sound emitting device 120 is directed downward toward the associated horizontal surface 25 so that the sound will reverberate within chamber 125 and then be deflected by surface 25 to the surroundings. Associated cycle lock-in 130 and on/off switch 131 are also depicted.

Figure 3:
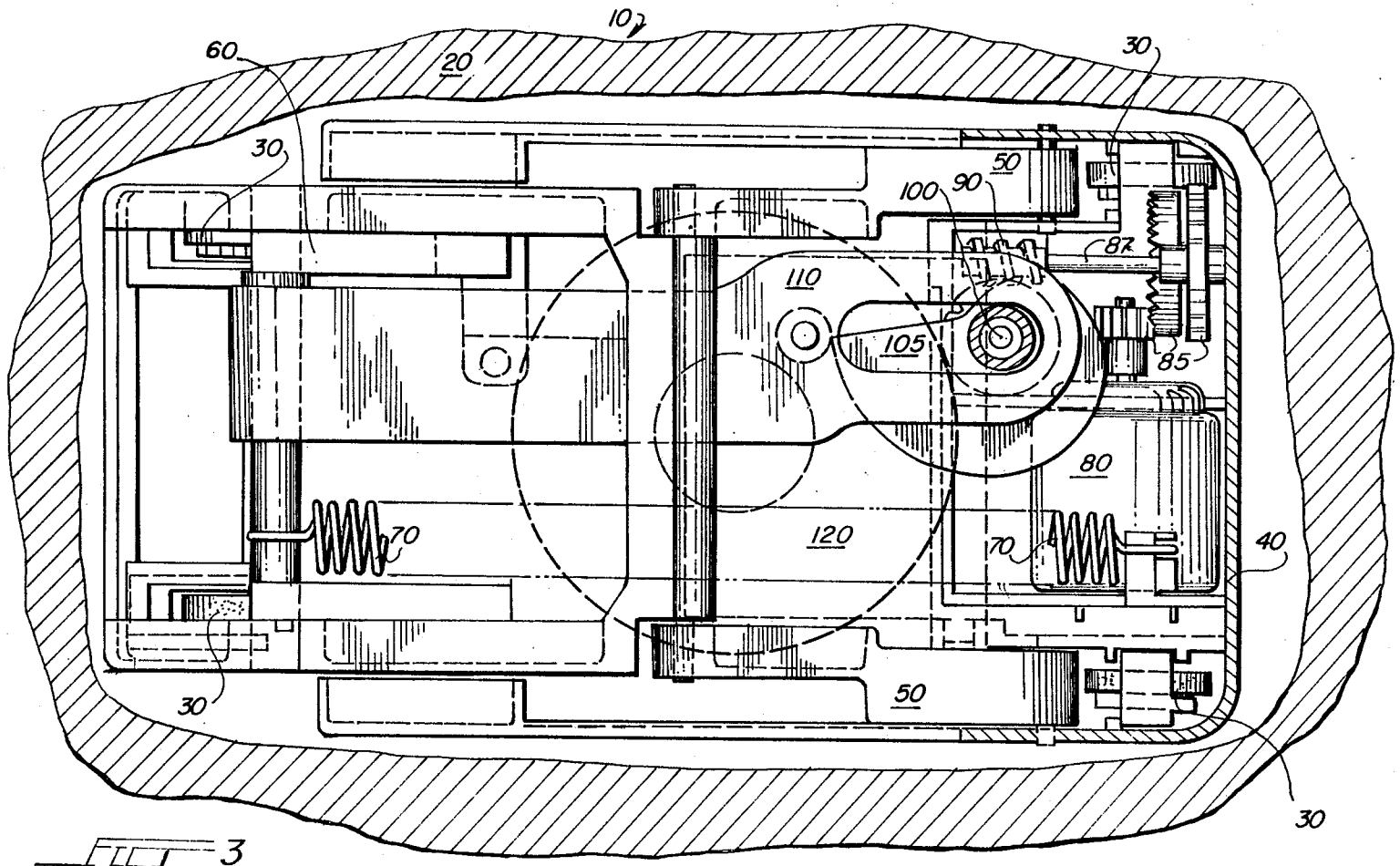
FIG. 3 is a top cut-away view of the present invention.

FIG. 3 is a top cut away view of the device 10 showing base 40 supporting motor 80. Motor 80 drives gear train 85 transmitting rotational energy through spindle 87 to worm gear 90 in order to drive cam gear assembly 100 and in turn, cam 105. Cam 105 provides the eccentric motion for the device 10. Cam follower assembly 110 couples with cam 105 to transfer eccentric motion into movement which extends yokes 50 away from yoke 60. Aft yoke 60 is jointly coupled to forward yoke 50 in which the other end of forward yoke 50 is affixed to base 40. Base 40 is supported by ratchet wheel assembly 30 on one end and aft yoke 60 on the other. Aft yoke 60 is supported by ratchet wheel assembly 30. Sound emitting device 120 is shown in outline form.

Figure 4:
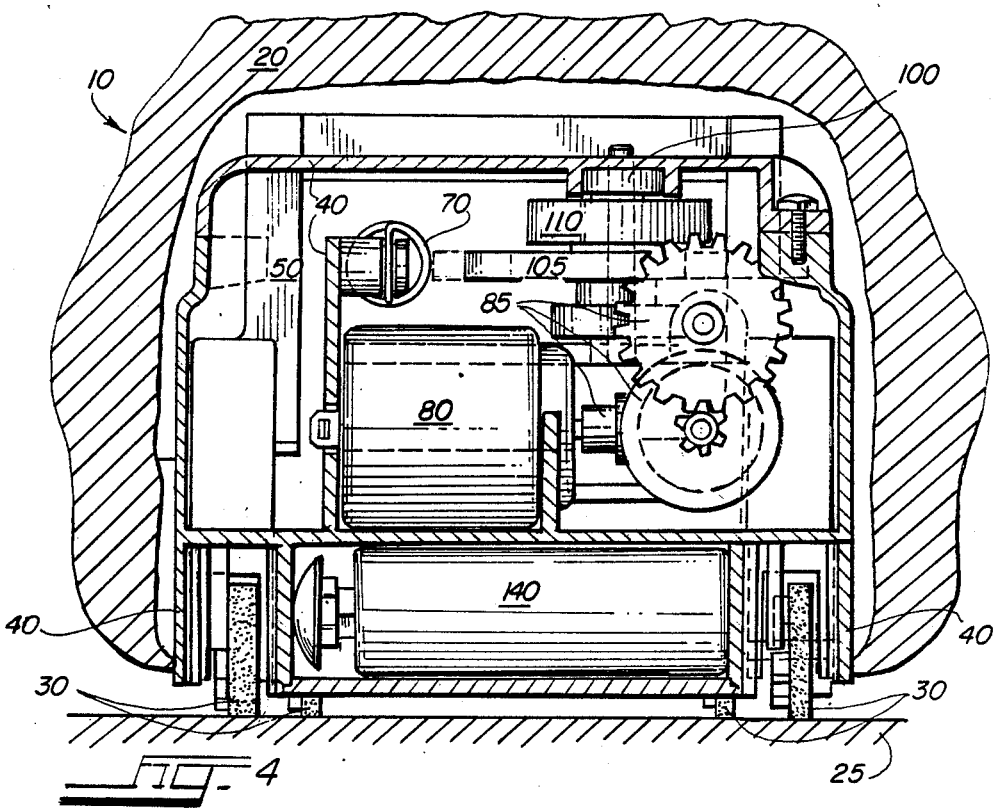
FIG. 4 is a front end cut-away view of the present invention.

FIG. 4 is a front end partial cut away view of the device 10 depicting battery 140 supported by base 40. Shell housing 20 is partially shown.

Figure 5:
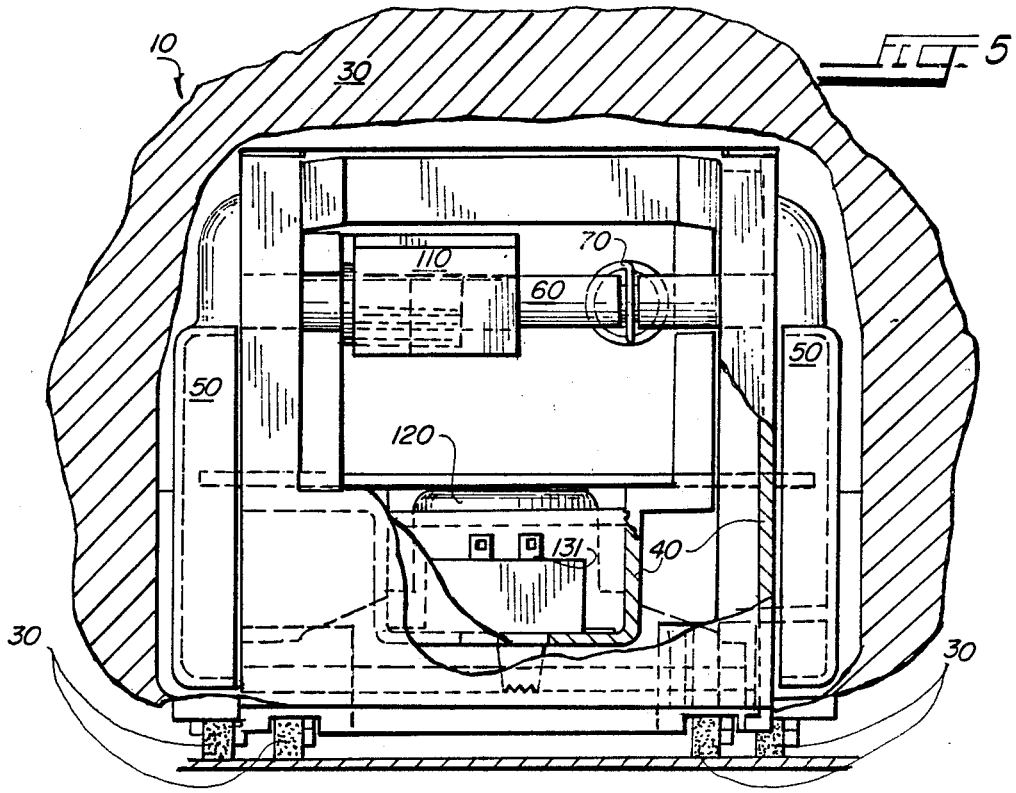
FIG. 5 is a back end cut-away view of the present invention.

FIG. 5 is a back end cut away view of the device 10 in which shell housing 20 is affixed to aft yoke 60. On/-off switch 131 is shown mounted within and extends beneath base 40. Ratchet wheel assemblies 30 are shown beneath aft yoke 60 and beneath the front end of base 40. Sound emitting device 120 is partially shown supported by base 40.

FIGS. 6 and 7 are top and side views respectively of the cam/gear assembly 110 and depicting cam 105.

FIGS. 8, 9 and 10 are top, side and end views respectively of the cam follower assembly 110.

Figure 11:
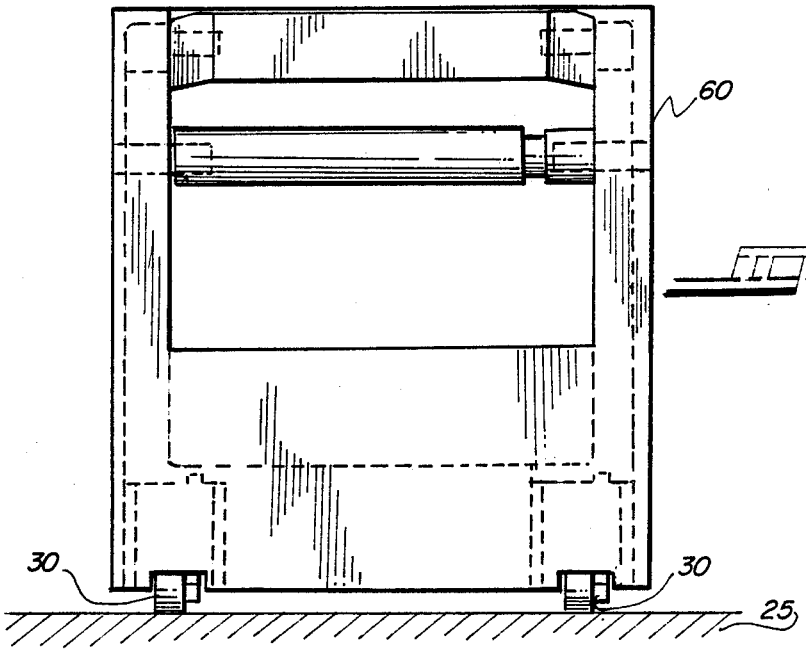
FIG. 11 is an elevational view of the aft yoke of the present invention.

FIG. 11 is an elevational view of the aft yoke 60 supported by ratchet wheels assemblies 30 upon an associated horizontal surface 25.

Figure 12:
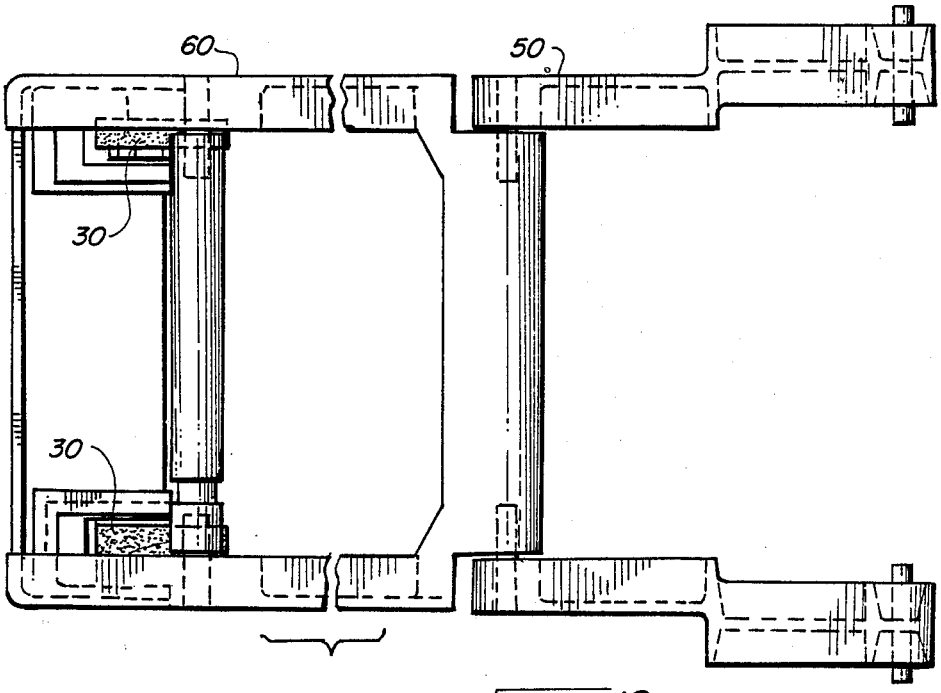
FIG. 12 is a top view of the jointed yoke assembly of the present invention.

FIG. 12 is a top view of the jointed yoke assembly showing aft yoke 60 and forward yoke 50 in which ratchet wheel assembly 30 supports aft yoke 60.

Figure 13:
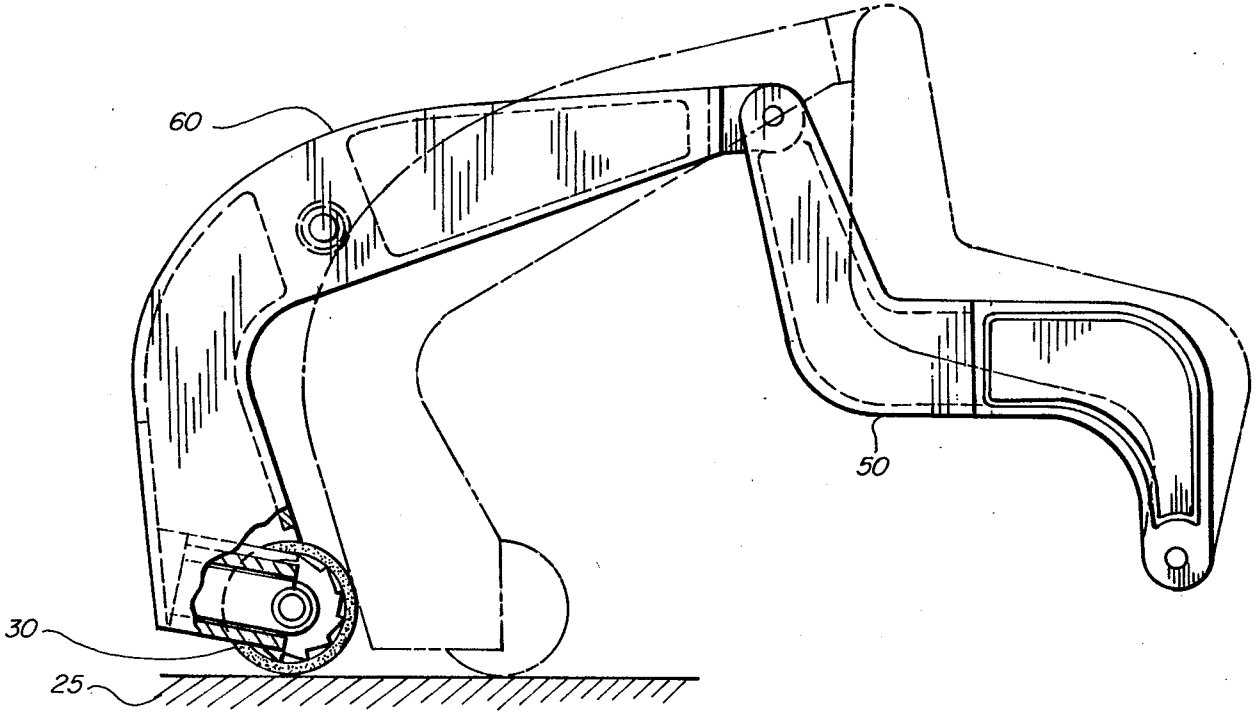
FIG. 13 is a side elevational view of the jointed yoke assembly of the present invention.

FIG. 13 is a side elevational view of the jointed yoke assembly depicting in outline form the motion of yokes 60 and 50. Aft yoke 60 is supported by ratchet wheel assembly 30 and associated horizontal surface 25.

FIG. 14 is a top view of forward yoke 50.

FIG. 15 is a side elevational view of conventional ratchet wheel assembly 30. FIG. 16 is a front view of FIG. 15 depicting the ratchet wheel assembly 30.

FIGS. 17 and 18 are top and side views of the reverberation chamber 125.

The operation of the present invention is simply and effectively described as follows. The overall invention is best understood by referring to FIGS. 2–5 in which on/off switch 131 is first positioned to connect associated cycle lock-in switch 130 with battery 140 to activate motor 80. Motor 80 provides rotational energy through gear train 85, spindle 87, worm gear 90 and to cam gear assembly 100 and cam 105. The eccentric motion of cam 105 is translated into longitudinal motion by cam follower assembly 110. The longitudinal motion of cam follower assembly 110 is transmitted to aft yoke 60 and through their coupling to yoke 50. Aft yoke 60 is biased by spring 70 toward the base 40. The longitudinal motion of cam follower assembly 110 cause yokes 50, 60 to operate in an oscillatory manner. Shell housing 20 is affixed to the exterior of aft yoke 50 and to the front of base 40 such that when aft yoke 60 oscillates it causes flexible shell 20 to move in an up and down motion, appearing to "cough."

Synchronously, the device 1( horizontally moves or "crawls" by the oscillatory motion of yokes 50 and 60. The movement of device 10 is first produced by the rotation of ratchet wheel assemblies 30 on aft yoke 60 during the first half of the oscillatory cycle while the ratchet wheel assemblies 30 of base 40 are locked by the conventional ratchet mechanism of the wheel assemblies 30. During the last half of the cycle, the reverse takes place, in which aft yoke 60 returns to its original position causing ratchet wheel assemblies 30 on base 40 to now rotate. This oscillatory motion is repeated cyclically by the eccentric motion produced by cam 105 and translated into longitudinal motion produced by cam follower assembly 110. The device's 10 horizontal motion or crawl is provided for in the present invention by the unique use of ratchet wheel assemblies 30 through the displaced motion of the aft yoke 60 jointed with the forward yoke 50.

Associated cycle lock-in switch 130 may be used to control various cycles and the duration of the eccentric motion produced and translated into longitudinal motion and in turn the amount of rotation of ratchet wheel assemblies 30 and the resulting horizontal travel of the device 10.

A reverberation chamber 125, in which sound emitting device 120 is positioned, enhances the "coughing" sound or other desired sounds produced by associated circuitry. Furthermore, speaker grill housing 127 is raised into base 40 and above associated horizontal surface 25 in order to increase the reverberation effect of chamber 125.

The amusement device of the present invention may be used with associated sound emitting circuitry causing verbal coughs or other verbal comments regarding smokers or "gag-lines" by celebrities. It is further envisioned that the device be activated by either a wired or wireless remote control device or be responsive to an internal smoke detection apparatus. Furthermore, it is envisioned that the device be configured with a conventional mechanism associated with the base or yoke assembly which will cause the entire device to roll over.

It is further intended that the eccentric motion means could be comprised of a rack and pinion type of assembly instead of the cam and follower assembly shown in the drawings and described herein. The flexible shell housing may be constructed of a self-skinning polyurethane or other conventional material so as to depict a "rock" or other article.

While the foregoing has presented certain specific embodiments of the present invention, it is to be understood that these embodiments have been presented by way of example only. It is expected that others will perceive differences which, while bearing from the foregoing, do not depart from the spirit and scope of the invention herein described and claimed.

I claim:

1. An amusement device, comprising:

a base frame having a first end and a second end;

at least one ratchet wheel assembly mounted to and supporting said second end of said base frame;

a prime mover mounted within said base frame;

a cam rotatably driven by said prime mover;

a yoke assembly having a first yoke and a second yoke, said second yoke activated by said cam to cause said first yoke to move in a scissor like motion relative to said second yoke and said first end of said base frame;

an elastic covering looking like a rock fixed to said base frame and said first yoke substantially covering from view said yoke assembly and said prime mover and being elastic enough to flex with said yoke assembly; and at least one ratchet wheel assembly mounted at said first yoke such that when said first yoke moves toward said second yoke, said ratchet wheel at said first yoke rotates while said ratchet wheel at said base is prevented from rotating and when said first yoke moves away from said second yoke said yoke ratchet wheel is prevented from rotating while said base ratchet wheel rotates resulting in movement of the device along a supporting surface.

2. The device of claim 1, wherein said cam forces the first and second yokes away from each other and a spring biasing means forces said yokes together.

3. The device of claim 1, wherein said cam forces the first and second yokes together and a spring biasing means forces said yoke away from each other.

4. The device of claim 2, further including a sound emitting device attached to said base frame where said sound emitting device is activated while the yokes are moving in a relative scissor like manner with each other.

5. The device of claim 4, wherein said sound emitting device emits a coughing sound.

6. The device of claim 5, wherein the relative movement of said yokes of said amusement device is in response to activation of a detector remotely operated by command.

7. The device of claim 6, wherein said means for providing motion forces the first and second yokes away from each other and a spring biasing means forces said yokes together.

8. The device of claim 7, wherein said sound emitting device emits a coughing sound in synchrony with the motion of said shell housing.

9. The device of claim 8, wherein the movement of said yoke assembly is remotely operated.

10. The device of claim 1, wherein the relative movement of said yoke of said amusement device is opened in response to activation of a detector.

11. A simulated rock comprising:

a base having a first end and a second end;

a means for providing motion comprising a prime mover mounted on said base and a yoke assembly having a first yoke and a second yoke; said second yoke moveable in a scissor like manner in relation to said first yoke;

a flexible cover resembling an inanimate object substantially covering from view said motion providing means;

a sound emitting device attached to said base; and while the yokes are moving in a relative scissor like manner, the sound emitting device is activated and the flexible cover is oscillated between an extended and a contracted condition by said yoke assembly driven by said prime mover resulting in a crawling movement.

12. The device of claim 11 wherein said means for providing motion forces the first and second yokes toward each other and spring biasing means forces said yokes apart.

* * * * *